United States Patent [19]

Thames

[11] 4,194,311

[45] Mar. 25, 1980

[54] GRAVE DIGGING APPARATUS

[76] Inventor: Jimmy Thames, 316 South St., Manning, S.C. 29102

[21] Appl. No.: 870,057

[22] Filed: Jan. 17, 1978

[51] Int. Cl.[2] ..... E02F 3/08; E02F 5/06

[52] U.S. Cl. ..... 37/192 A; 37/DIG. 6

[58] Field of Search ..... 37/DIG. 6, 83, 85, 86, 37/191 A, 191 R, 192 R, 192 A

[56] References Cited

U.S. PATENT DOCUMENTS

| | | | |
|---|---|---|---|
| 1,159,173 | 11/1915 | Bunnell | 37/85 |
| 1,782,478 | 11/1930 | Ruth | 37/85 |
| 1,832,787 | 11/1931 | Penote | 37/83 |
| 2,624,129 | 1/1953 | Steece | 37/DIG. 6 |
| 2,673,407 | 3/1954 | Williams | 37/192 R X |
| 2,872,157 | 2/1959 | Brell | 37/DIG. 6 |
| 3,603,010 | 9/1971 | Polinek | 37/192 R X |
| 3,626,613 | 12/1971 | Jullien et al. | 37/192 R X |
| 3,690,023 | 9/1972 | Peterson | 37/192 R X |

*Primary Examiner*—Clifford D. Crowder
*Attorney, Agent, or Firm*—L. Lawton Rogers, III

[57] ABSTRACT

A compact, efficient grave digger is disclosed including a support frame and an excavation assembly which is carried by the support frame. The excavation assembly moves in a vertical direction beneath the support frame so that a grave may be excavated in a single downward pass of the excavation assembly. The grave digger includes a plurality of endless conveyors which loosen and remove the earth from beneath the excavation assembly. The support frame includes ground engaging wheels so that the grave digger may be selectively positioned at the grave site. Hydraulic jacks connect the excavation assembly with the support frame so that the excavation assembly may be raised and lowered with respect to the support frame. The excavation assembly may be adjusted so that graves of different lengths may be excavated.

12 Claims, 5 Drawing Figures

GRAVE DIGGING APPARATUS

BACKGROUND OF THE INVENTION

Machines for excavating graves and the like have, in general, been largely commercially impractical because of various problems involved in their construction and operation. Grave digging machines typically include a support frame of some type which remains at all times upon the surface of the ground. An excavation assembly that is supported by the frame, usually loosens the earth to be excavated and transports the earth out of the gravesite.

Grave digging machines may typically be classified into one of two categories. The first category includes grave diggers which excavate the grave by both a horizontal and a vertical movement of an excavation assembly such as is illustrated in U.S. Pat. No. 3,577,664 issued to T. J. Sing. Typically, an endless conveyor which is elongated in a vertical direction is initially moved vertically into the ground until a portion of the vertical conveyor is below the surface of the ground. Then the excavation assembly, including the vertical conveyor, is moved horizontally so as to excavate the grave along its length.

Typically grave diggers which operate in this manner require a number of horizontal passes in order to excavate a grave of desired dimensions. Since these grave diggers excavate the grave by the movement of an excavation assembly in a horizontal direction, the excavation assembly usually exerts a considerable horizontal force on the support frame. Consequently, the support frame of the grave digger must include means so as to remain stationary with respect to the surface of the ground. In loosely packed soil, the ground engaging means of the support frame of the grave digger may slide horizontally and thereby destroy grass and other vegetation surrounding the gravesite.

Grave diggers of the second category excavate the grave by a single vertical movement of an excavation assembly. Like the other grave diggers, these excavators generally include a support frame which remains at the surface of the ground. An exacavation assembly is usually supported by the frame, but is restricted to movement with respect to the frame in a vertical direction only. Consequently, these grave diggers are typically not subjected to the considerable horizontal forces of the first category of grave diggers.

The excavation assembly generally includes an endless conveyor which is of the same general horizontal dimensions as a grave, when the conveyor is viewed from below. A grave is excavated by lowering the excavation assembly vertically downward until the grave has been excavated to a desired depth. Grave diggers of this category may operate more quickly and more efficiently than other grave diggers because the excavation requires a single pass of the excavation assembly. Grave diggers which operate in a generally vertical direction also may utilize the weight of the grave digger to urge the excavation assembly into vertical engagement with the earth.

However, grave diggers which excavate the earth by a vertical movement of an excavation assembly have been costly and expensive to operate because of the enormous size of the endless conveyor used in their construction. One type of grave digger, such as is illustrated in U.S. Pat. No. 2,501,083 issued to W. A. Owen, uses the same endless conveyor which loosens the earth from beneath the excavation assembly to transport the earth out of the grave. If the length of the conveyor which carries the digging implements can be minimized, not only can the overall cost of the machine be reduced, but also the expense of operation of the grave digger may be decreased.

Accordingly, it is an object of the present invention to provide a novel grave digger which excavates a grave in a single vertical pass of an excavation assembly that is economical in cost and operation by reason of a shortening of the length of the conveyor which carries the digging implements of the excavation assembly.

It is another object of the present invention to provide a novel grave digger having a plurality of endless conveyors to remove the loosened earth from the excavation thereby permitting a shortening of the length of the endless conveyor that carries the digging implements of the excavation assembly.

Grave diggers which utilize the same endless conveyor to both loosen the earth from below the excavation assembly and to transport the loosened earth out of the grave, typically have a rather high center of gravity. The center of gravity of grave diggers may be significantly lowered if the heavy endless conveyor which carries the digging implements may travel only at the lower end of the excavation assembly. A low center of gravity for the grave digger would result in greatly increased stability during operation of the machine.

Accordingly, it is yet another object of the present invention to provide a novel grave digger having an endless conveyor for carrying digging implements that travels in a path located at the lower portion of an excavation assembly thereby resulting in a grave digger having a low center of gravity and a greatly increased stability during the excavation of a grave.

Very often it is desirable to be able to excavate graves of a cemetery during the day while the cementary may be open to the public. However, the noise that results from the operation of a grave digger tends to disturb the peaceful, quite atmosphere that is characteristic of many cemeteries. Therefore, it is oftentimes necessary to excavate graves only while the cemetery is closed to the public such as during the night.

In spite of the use of mufflers and other noise reducing devices, much of the noise that results from a grave digger which is powered by an internal combustion engine is actually due to the operation of the engine itself. If the noise of the engine could be reduced, the grave digger may be operated while the cemetery is open to the public without causing a disturbance to visitors to the cemetery.

Accordingly, it is still another object of the present invention to provide a novel grave digger which is powered by an internal combustion engine that is relatively quiet in operation as a result of a location of the engine on the grave digger. The engine, located above the excavation assembly travels into the grave as excavation proceeds, so that the grave itself may direct and muffle the sound.

The length of various caskets varies considerably between one another, such as between children's and adult's caskets. Because of the expense involved in the excavation of a grave and because of the close proximity of caskets in some cemeteries, it is oftentimes a requirement that graves of different lengths be excavated. Previous grave diggers which operate in a horizontal movement of an excavation assembly, such as those cited above, are capable of excavating graves of different lengths merely by limiting the horizontal travel of the excavation assembly. Grave diggers which excavate a grave in one vertical movement of an excavation assembly, however, have been unable to be easily adjusted so as to excavate graves of different lengths because of the massive structure necessary to support the chain of the excavation assembly.

Accordingly, a further object of the present invention is to provide a novel grave digger which may easily be adjusted so as to enable graves of different lengths to be excavated in single vertical movements of an excavation assembly.

Yet another object of the present invention is to provide a novel grave digger which may be adjusted by means of a slidably removable axle and rollers so as to enable graves of different lengths to be excavated in single downward movements of an excavation assembly.

These and other objects of the invention will become apparent from the claims and from the following description when read in conjunction with the appended drawings.

THE DRAWINGS

DETAILED DESCRIPTION OF PREFERRED EMBODIMENTS

Figure 1:
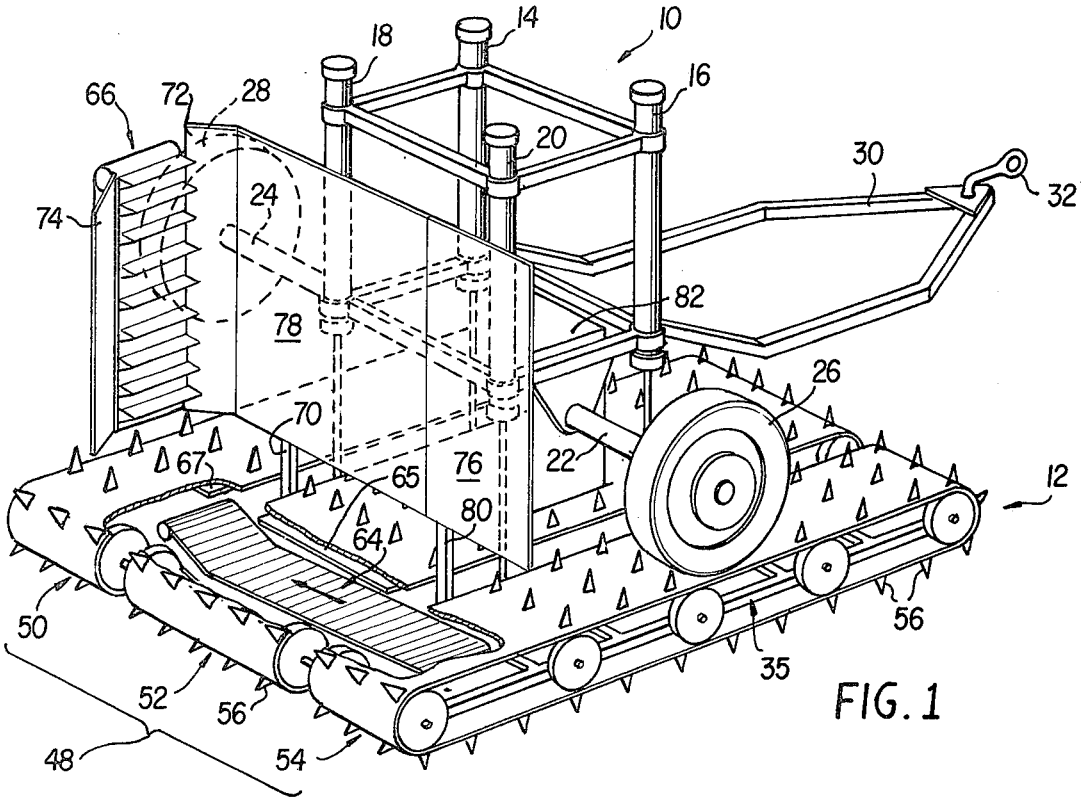
FIG. 1 is a pictorial view of one embodiment of the grave digger of the present invention, including cutaway views of portions of the invention.

A preferred embodiment of the grave digging apparatus of the present invention includes, with reference to FIG. 1, a rectangular support frame 10 and an excavation assembly 12 which is supported by the frame by means of four hydraulic jacks 14, 16, 18, 20. The hydraulic jacks 14, 16, 18, 20 raise and lower the excavation assembly 12 in a vertical direction with respect to the support frame 10.

The support frame 10 includes a pair of axles 22,24 and wheels 26, 28. The grave digging apparatus may be easily rolled about on the surface of the ground on the wheels 26, 28. The axles 22, 24 are located on either side of the support frame 10 so as not to obstruct the vertical movement of the excavation assembly 12. The wheels 26, 28 are of a size large enough so that the grave digger may be moved without permitting the excavation assembly to come into contact with the surface of the ground while the excavation assembly is at its extreme vertical position. A tow bar 30 and trailer hitch 32 are attached to the support frame 10 so as to facilitate movement of the grave digging apparatus by means of a conventional vehicle such as a tractor. The wheels 26, 28 may include a braking means of a design and operation that is well known in the art so that the grave digging apparatus may be selectively immobilized with respect to the ground. Alternatively, other ground engaging members; e.g., hydraulically operated legs which are well known in the art of excavation apparatus, may be attached to the support frame so as to provide ground engaging support for the grave digging apparatus.

Figure 3:
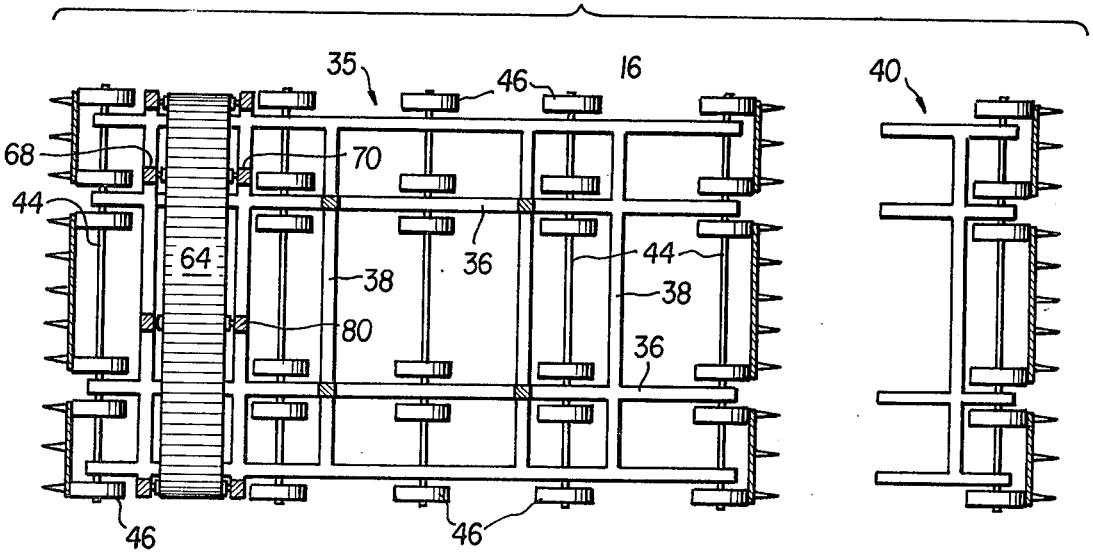
FIG. 3 is a top plan view of the grave digger of FIG. 1 with a section taken through lines 3—3 of FIG. 2 illustrating adjustment of the length of the excavation assembly of FIG. 1.

The excavation assembly 12, which is supported by the frame 10, includes a system of endless conveyors which excavate the earth of the grave and transport the earth to the surface of the ground. In the preferred embodiment of FIG. 1, the excavation assembly 12 includes a subframe 35 attached to one end of hydraulic jacks 14, 16, 18, 20. As illustrated in FIG. 3, the subframe 35 consists of a network of horizontally oriented beams 36 which are connected to each other by cross members 38. The subframe 35 may include a section 40 which is removable from the subframe 35, so that the length of the subframe 35 may be adjusted for excavating graves of two different lengths. In another embodiment of the grave digging apparatus, illustrated in FIG. 4, section 41 of the subframe 35 is slidably movable so that different size graves may be excavated by the grave digging apparatus.

In the preferred embodiment of FIG. 3, the beams 36 of the subframe 35 support a plurality of axles 44 which are arranged parallel to each other and oriented in a generally horizontal manner at right angles to the beams 36. The axles 44 support a plurality of rollers 46 which provide a means of support for a first endless conveyor 48. As illustrated in FIG. 1, the first endless conveyor may consist of three adjacent parallel belt sections 50, 52, 54, so that the hydraulic jacks 14, 16, 18, 20 may be located within the path of the first endless conveyor and may be connected to the subframe 35. The belts 50, 52, 54, are comprised of a plurality of links 58 so as to facilitate a shortening or lengthening of the belt.

Figure 4:
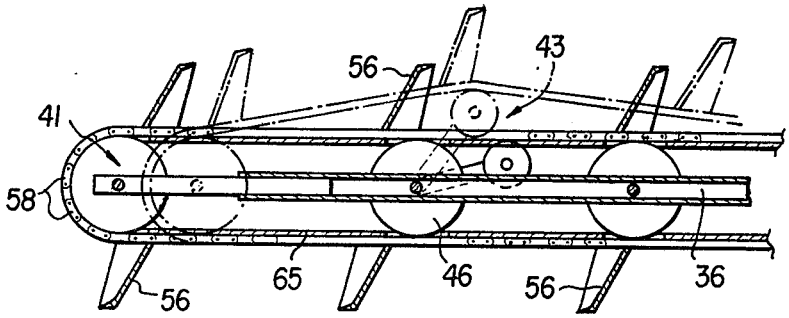
FIG. 4 is a side view of a portion of the excavation assembly of the grave digger of FIG. 1 illustrating a second embodiment of adjustment of the length of the excavation assembly of FIG. 1; and, FIG. 5 is a section taken through lines 5—5 of FIG. 2, illustrating an embodiment of the operation of the earth conveyors of the grave digger of FIG. 1.

As illustrated in FIG. 4, an idler assembly 43 may be provided so as to maintain tension in the first endless conveyor belts 50, 52, 54 when section 41 of the subframe 35 has been moved with respect to the subframe. Alternatively, if graves of only two different lengths are to be excavated, the belts 50, 52, 54 may include a section of predetermined length which is easily removed so as to shorten the length of the belts 50, 52, 54.

With reference to the embodiment shown in FIG. 1, the belts 50, 52, 54 may carry a plurality of digging implements 56 which are arranged in parallel rows. The digging implements may comprise scoops which loosen the earth from the floor and walls of the grave and carry the loosened earth from below the excavation assembly 12 to above the first endless conveyor 48.

In the preferred embodiment of FIG. 1, the first endless conveyor 48 comprises a horizontally elongated loop traveling in a path about the subframe 35. A second endless conveyor 64 is located at one end of the subframe and within the first endless conveyor 48. The first endless conveyor travels around the subframe 35 so that the conveyor may carry loosened earth from beneath the subframe to above the second endless conveyor 64.

The first endless conveyor 48 may be perforate so that the loosened earth which has been transported by the conveyor 48 may pass through the path of the conveyor and fall onto the second endless conveyor 64. A series of smooth backing plates 65 may be located between the subframe 35 and the first endless conveyor 48 about the entire path of the first endless conveyor 48 except in the region above the second endless conveyor 64. The plates 65 may be provided so that the earth that has been loosened by the digging implements 56 may not pass within the path of the endless conveyor until the loosened earth is above the second endless conveyor 64. The plates 65 may have end portions 67 so as to further direct the earth onto the second endless conveyor 64.

Figure 5:
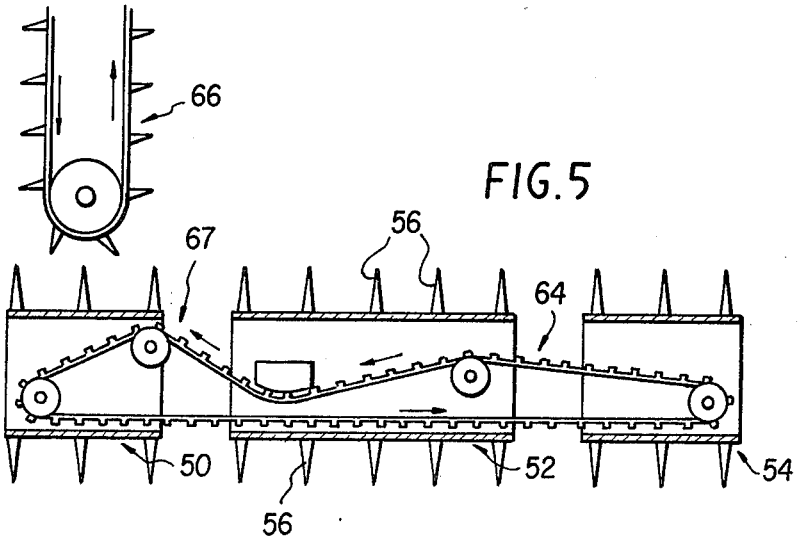

The second endless conveyor 64 comprises a generally elongated loop that is oriented transversely to the first endless conveyor 48. With reference to FIG. 5, a region 67 of abrupt change of direction of travel of the second endless conveyor 64 is provided so that the loosened earth which is carried by the second endless conveyor 64 may be propelled in a horizontal and vertical direction through the belts of the first endless conveyor 50, 52, 54.

In the preferred embodiment, the second endless conveyor 64 moves at a rate of travel that is more than twice as fast as the first endless conveyor 48. The rate of travel of the second endless conveyor 64 must be sufficient so as to propel the loosened earth through the path of the first endless conveyor 48 and onto a third endless conveyor 66. The third endless conveyor is arranged so that the earth received from the second endless conveyor may be transported vertically out of the grave. The third endless conveyor 66 may be attached to the subframe 35 by means of vertical beams 68, 70. Guides 72, 74 may be attached to beams 68, 70 so as to direct the loosened earth onto the third endless conveyor. Other guides 76, 78 may be supported by beams 70, 80 so as to further direct the loosened earth towards the second endless conveyor 64.

Figure 2:
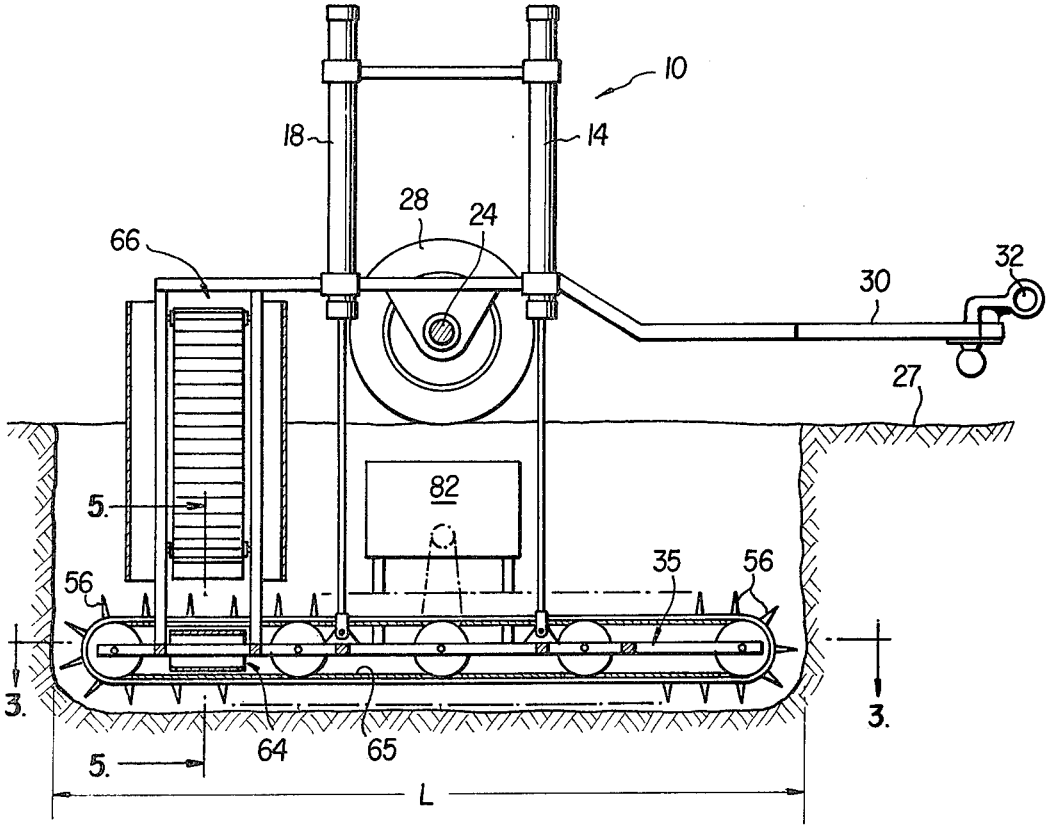
FIG. 2 is a side view of the grave digger of FIG. 1, illustrating the excavation of a grave.

With reference to FIG. 2, the grave digger is illustrated during the excavation of a grave. Note that the wheel 26 remains on the surface of the ground 27. The length L of the grave is determined by the distance between the outermost tips of the digging implements 56.

A motor which is located in the motor box 82 above the subframe 35 is used to drive the three endless conveyors by means of appropriate gearing and drive wheels. A hydraulic pump may be included in the motor box 82 to operate the hydraulic jacks 14, 16, 18, 20.

An additional motor (not shown) may be provided to drive the ground engaging wheels 26 and 28, so that the grave digger may be self-propelled. In that event, modifications which are obvious to one skilled in the art, such as the provision of steering means and additional ground engaging wheels may be made to the grave digger without departing from the spirit and scope of the present invention.

As shown in the preferred embodiment, of FIG. 2, both the motor and the hydraulic pump travel beneath the surface of the ground during the excavation of a grave. The presence of the motor and hydraulic pump beneath the surface of the ground greatly reduces the disturbance to the surrounding area caused by the noise of the grave digger. Accordingly, the lessened noise of operation of the grave digger may permit the more frequent use of the grave digger in a cemetery without creating a disturbance to visitors to the cemetery.

The principles, preferred embodiments and modes of operation of the present invention have been described in the foregoing specifications. The invention which is intended to be protected is not, however, to be construed as limited to the particular forms disclosed, since these are to be regarded as illustrative rather than restrictive. Variations and changes may be made by those skilled in the art without departing from the spirit and scope of the present invention.

What is claimed is:

1. An apparatus for excavating a grave of a predetermined depth comprising:

a support frame having a plurality of ground engaging wheels, said frame being selectively positionable at a gravesite and including a plurality of members selectively positioned with respect to the gravesite so as to engage the surface of the ground at a plurality of locations about the gravesite to thereby resist movement of the frame relative to said gravesite; and, an excavation assembly for excavating earth at the gravesite, said excavation assembly being carried by said support frame and being selectively movable relative to the support frame in a vertical direction below the surface of the ground to the predetermined depth of the grave to be excavated but restrained from movement in a horizontal direction relative to the support frame, said excavation assembly including:

an articulated first endless conveyor means bearing a plurality of digging implements and configured in a horizontally elongated loop having a vertical height substantially less than the predetermined depth of the grave to be excavated for removing earth beneath the excavation assembly, the loop having a dimension in the direction of elongation approximately that of the length of the grave being excavated, and said first endless conveyor having a width approximately that of the width of the grave, so that the grave may be excavated in a single downward movement of the excavation assembly, second endless conveyor means for collecting the earth excavated by said digging implements and for transporting the excavated earth, third endless conveyor means engaged to said excavation assembly for receiving the excavated earth from said second means and for vertically transporting the excavated earth received from said second conveyor means above the surface of the ground and away from the gravesite, and, a motor carried by said excavation assembly for driving said conveyors along their endless paths.

2. The apparatus of claim 1 wherein the dimension of the loop in the direction of elongation is selectively variable for excavating graves of different length by single downward movements of the excavation assembly.

3. The apparatus of claim 2 wherein the excavation assembly includes a plurality of rolling members about which the first endless conveyor moves in its endless path and wherein the dimension of the loop in the direction of elongation is varied by varying the number of the rolling members.

4. The apparatus of claim 2 wherein the dimension of the loop in the direction of elongation is varied by varying the horizontal spacing between the rolling members while maintaining approximately constant tension on the first endless conveyor.

5. The apparatus of claim 4 wherein the tension of the first endless conveyor is maintained approximately constant by an idler assembly.

6. In a grave excavating apparatus including a support frame which remains at all times on the surface of the ground and an excavation assembly which is supported by the frame and movable in a vertical direction with respect to the frame so as to permit the excavation of a grave of a predetermined depth in a single downward movement of the excavation assembly, the improvement comprising a plurality of endless conveyors arranged on the excavation assembly so as to loosen and transfer the excavated teeth of the grave away from the gravesite, wherein a first endless conveyor, configured in a horizontally elongated loop having a vertical height substantially less than the predetermined depth of the grave to be excavated, having a width and length corresponding to the width and length of the grave, and carrying a plurality of digging implements, excavates earth beneath said first conveyor and transports the excavated earth to a second endless conveyor; said second endless conveyor transporting the loosened earth to a third endless conveyor which transports the excavated earth in a generally vertical direction out of the grave.

7. The apparatus of claim 6 wherein said first endless conveyor is perforate so as to permit the excavated earth to pass through the path of the first endless conveyor and said second endless conveyor travels substantially within the endless path of said first endless conveyor, collecting the excavated earth which has passed through the path of the first endless conveyor.

8. The apparatus of claim 7 wherein said first and second endless conveyors are horizontally elongated, each conveyor having a major axis along the direction of the elongation, said first conveyor having its major axis along the length of the grave to be excavated and said second conveyor having its major axis substantially perpendicular to the major axis of the first conveyor.

9. In a grave excavating apparatus including a support frame which remains at all times on the surface of the ground and an excavation assembly which is supported by the frame and movable in a vertical direction with respect to the frame so as to permit the excavation of a grave in a single downward movement of the excavation assembly, the improvement comprising a plurality of endless conveyors arranged on the excavation assembly so as to loosen and transfer the excavated earth of the grave away from the gravesite, wherein a first endless conveyor, carrying a plurality of digging implements excavates earth beneath said first conveyor and transports the excavated earth to a second endless conveyor; said second endless conveyor transporting the loosened earth to a third endless conveyor which transports the excavated earth in a generally vertical direction out of the grave, said first endless conveyor being perforate so as to permit the excavated earth to pass through the path of the first endless conveyor and said second endless conveyor traveling substantially within the endless path of said first endless conveyor, collecting the excavated earth which has passed through the path of the first endless conveyor, said first endless conveyor including first and second portions spaced away from one another so as to provide a passageway from an interior of the first endless conveyor to the exterior of the first endless conveyor and said second endless conveyor propelling said loosened dirt through said passageway opening of said first endless conveyor and onto said third endless conveyor.

10. The apparatus of claim 9 wherein said first and second endless conveyors are horizontally elongated, each conveyor having a major axis along the direction of the elongation, said first conveyor having its major axis along the length of the grave to be excavated and said second conveyor having its major axis substantially perpendicular to the major axis of the first conveyor.

11. The apparatus of claim 10 wherein the dimension of the first endless conveyor along the major axis is selectively variable for excavating graves of different length by single downward movements of the excavation assembly.

12. The apparatus of claim 9 wherein the first endless conveyor is configured in a horizontally elongated loop having a vertical height substantially less than a predetermined depth of the grave to be excavated.

* * * * *